US005206617A

United States Patent [19]

Bolz

[11] Patent Number: 5,206,617

[45] Date of Patent: Apr. 27, 1993

[54] AUXILIARY SWITCH FOR AN ELECTROMAGNETIC SWITCHING DEVICE

[76] Inventor: Jakob Bolz, Nikolaus-GroB-Str. 4, D-5300 Bonn 1 / FRG, Fed. Rep. of Germany

[21] Appl. No.: 778,803

[22] PCT Filed: Jun. 21, 1989

[86] PCT No.: PCT/EP89/00695

§ 371 Date: Dec. 19, 1991

§ 102(e) Date: Dec. 19, 1991

[87] PCT Pub. No.: WO90/16077

PCT Pub. Date: Dec. 27, 1990

[51] Int. Cl.[5] ..... H01H 67/02

[52] U.S. Cl. ..... 335/132; 200/506

[58] Field of Search ..... 335/131-133, 335/202; 200/50 C, 50 A

[56] References Cited

U.S. PATENT DOCUMENTS 4,117,429 9/1978 Streich et al. ..... 335/132

4,578,659 3/1986 Suter et al. ..... 335/131

*Primary Examiner*—Lincoln Donovan

*Attorney, Agent, or Firm*—Antonelli, Terry Stout & Kraus

[57] ABSTRACT

An auxiliary switch for an electromagnetic switching device with two pressure springs (2, 3) arranged outside of the axis of movement (1) of the contact bridge support (10), these pressure springs being supported in the manner of a two-armed toggle joint respectively with one end in respectively one of blind holes or the like formed on mutually opposite sides of the contact bridge support (10) and with the other end in respectively one of recesses provided in the housing sections (A, B) and exhibiting a negative return spring characteristic against the tensile force of the drive.

6 Claims, 2 Drawing Sheets

AUXILIARY SWITCH FOR AN ELECTROMAGNETIC SWITCHING DEVICE

The invention relates to an auxiliary switch for an electromagnetic switching device, this switch comprising, in a multipartite housing equipped with fixed contacts, a contact bridge support secured in its position by means of a pressure spring and movable against the spring force upon energization/nonenergization of the drive, this contact bridge support being provided with bridge contacts.

Auxiliary switches with positively guided auxiliary contacts, which can be designed as make and/or break contacts, for attachment to electromagnetic contactors have been conventional. Customarily, the pressure spring holding the contact bridge support against the tension of the magnet is arranged adjoining the contact bridge support in the axis of movement of the latter and is accommodated in a corresponding chamber formed by the housing sections encompassing the contact bridge support.

The invention is based on the object of further developing the conventional auxiliary switch in such a way that the balance of forces of the electromagnetic switching device and thus the response values of the basic device are altered only insubstantially by the attachment of an additional auxiliary switch.

This object has been attained according to the invention for an auxiliary switch by providing that two pressure springs located outside of the axis of movement of the contact bridge bearer are supported in the manner of a two-armed toggle joint respectively with one end in respectively one of blind holes or the like formed on mutually opposite sides of the contact bridge bearer and with the other end in respectively one of recesses provided in the housing sections, and exhibit a negative return spring characteristic against the tensile force of the drive.

The arrangement according to this invention of two obliquely disposed, mutually counteracting pressure springs, especially coil springs, brings about a decreased counter force with an increasing stroke distance, i.e. when the spring axes approach the perpendicular to the stroke movement axes. Consequently, the task according to this invention is accomplished. This arrangement of two pressure springs also makes it possible to reduce the structural length of the auxiliary switch without restricting the spring stroke.

In a further development of the invention, the principle of negative spring characteristic for the restoring force is to be designed so that the spring axes of the pressure springs in the holding condition (upon excitation of the magnet) extend almost perpendicularly to the axis of movement of the contact bridge support.

A simplified mounting of the auxiliary switch is made possible according to another suggestion provided by the invention by the feature that the recesses formed in the housing sections on the side facing the contact bridge support exhibit a pass-through opening toward the topside of the housing, through which the pressure springs can be introduced with the housing having been assembled. This means that the pressure springs are inserted only after the contact bridge support has been assembled with the housing sections. The housing sections of the auxiliary switch are connectible with each other in a shape-mating fashion, for example, by means of detent lugs, projecting along the parting joint at the housing walls of a housing section, and associated detent grooves at the second housing section. In a preferred embodiment of the housing sections of the auxiliary switch, the provision is made that the recess for the mounting and support of the pressure spring is arranged in each housing section between the contact switching chambers of the housing sections centrally as a chamber oriented into the interior of the housing.

It is to be noted that the principle of negative spring characteristic by means of two C-shaped wire springs and, respectively, the use of two obliquely disposed mutually counteracting springs effecting a lower counter force with increasing stroke have been known for the armature return of electromagnetic switching devices; in this connection, it is merely necessary to point, for example, to the Patent Application K 10523 of Apr. 29, 1951, DOS 3,340,904, DAS 2,350,914, DOS 2,848,287, and EP-OS 00 91 082.

The invention will be described in greater detail with reference to the embodiment illustrated in the drawing wherein.

Figure 1:
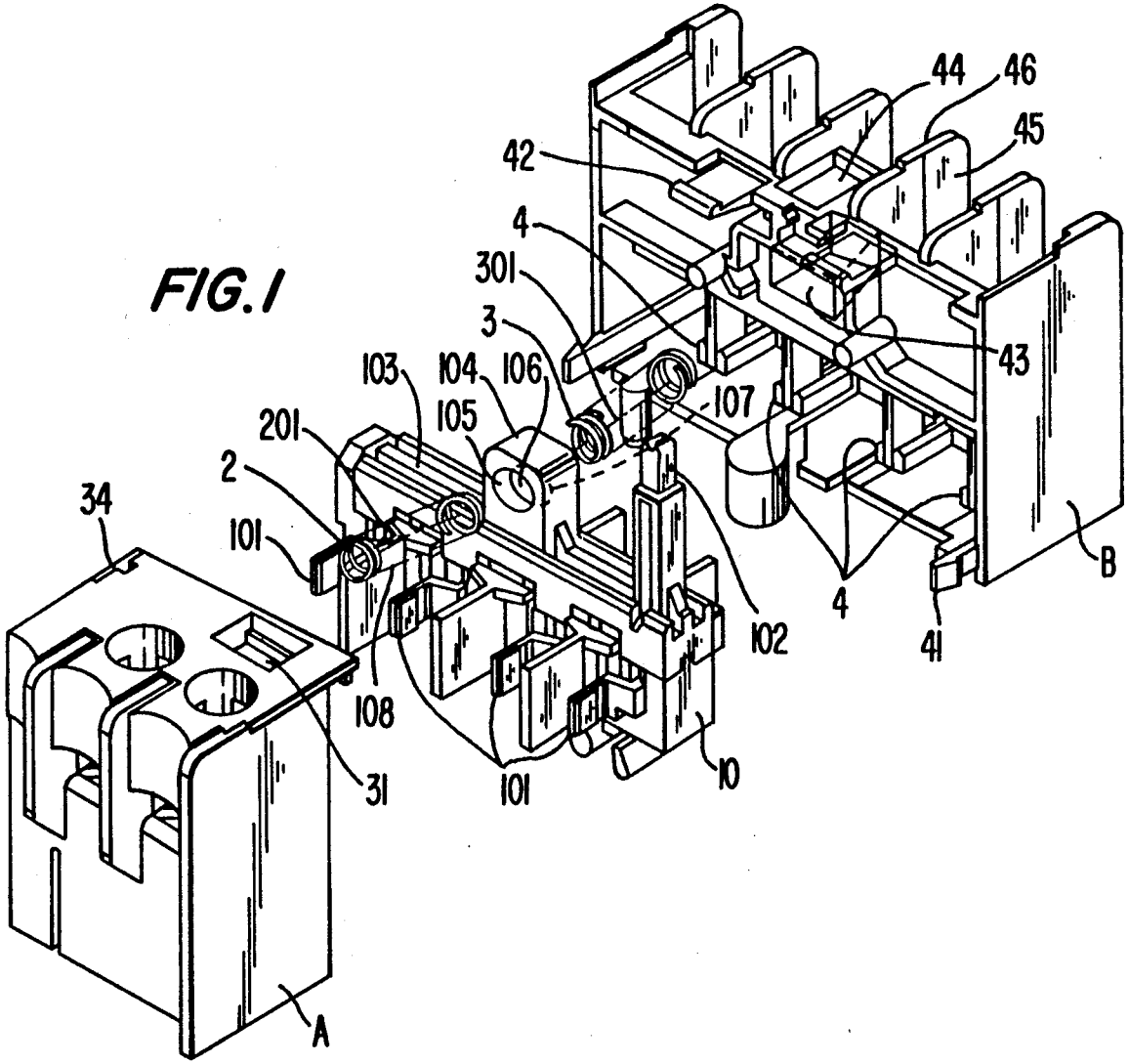
FIG. 1 shows an isometric representation of an auxiliary switch.

FIG. 1 shows an auxiliary switch with four make contacts in isometric illustration of the two housing parts A, B, the contact bridge support 10, and the pressure springs 2, 3. The contact bridge support 10 is studded in a conventional way with the bridge contacts 101 as make and/or break contacts and exhibits the projecting contact stem 102 in the zone of one end on the topside 103. The bearing block 104 is formed centrally on the topside of the contact bridge support 10; this bearing block exhibits blind holes 105 and 107, respectively, oriented toward the two sides and separated by the partition 106. The partition 106 at the base of the blind holes constitutes the bearing surface for the pressure springs 2, 3 and is preferably arranged to be slightly inclined with regard to the longitudinal axis 1 of the contact bridge support 10 so that the spring axes 201, 301 are in a concave position in the turned-on state as well as in the turned-off state, based on the plane 108 extending perpendicularly to the axis of movement 1 of the contact bridge support 10 through the spring center at the contact bridge support.

Figure 3:
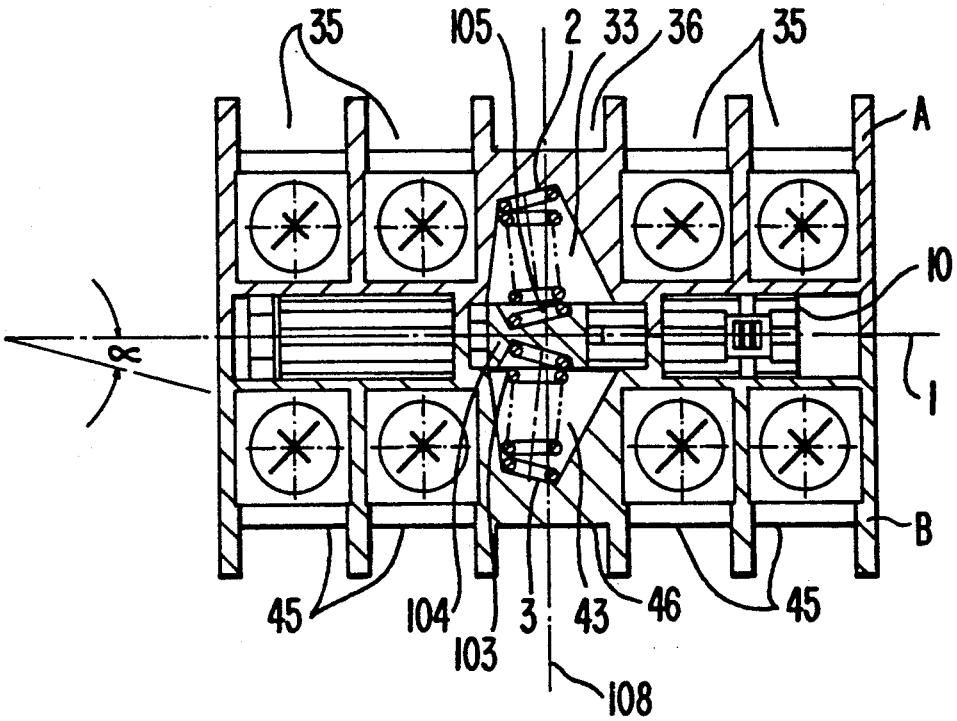
FIG. 3 shows a horizontal cross section through the auxiliary switch in the turned-on position.

The housing halves A, B exhibit on their outside the switching chambers 35, 45; an intermediate chamber 46 and, respectively, 36 encompassing the recesses 43, 33 for accommodating the pressure springs 2, 3 is arranged centrally between respectively two switching chambers 45. On the side facing the interior of the housing, the fixed contacts 4 are provided. Above the fixed contacts 4, the receiving chamber for supporting one end of the pressure springs 2, 3 is formed approximately centrally in the housing in the form of the recesses 43 and 33 in the housing sections. The recesses 33, 43 constitute a space flaring toward the contact bridge support 10; the rear wall of this space where the pressure springs 2 and 3 are supported does not extend in parallel to the axis of movement 1 of the contact bridge support but rather extends at a small angle $\alpha$ of about 10°–20° inclined with respect to the axis of movement 1. The bearing surfaces in the blind holes 105, 107 of the contact bridge support for the pressure springs are likewise disposed in parallel to this rear wall. This feature attains the objective according to this invention that, in the energized condition of the drive for the contactor i.e. the electromagnetic switching device, see FIG. 3, in the attracted condition, the spring force of the pressure springs against the drive of the contactor goes toward zero, but does not have a passage through the dead center; rather, the spring axes in all cases remain at an angle $\beta$ smaller than 90° with respect to the axis of movement 1 of the contact bridge support 10.

Figure 2:
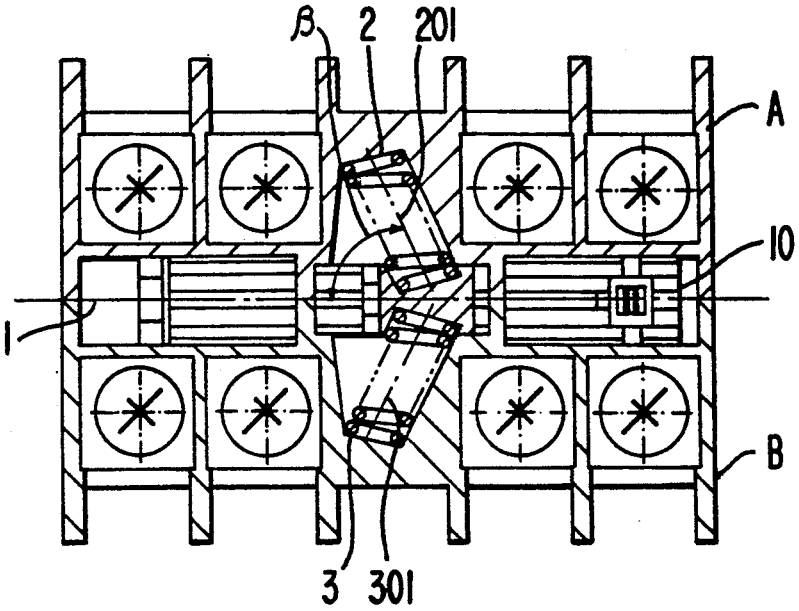
FIG. 2 shows a horizontal section through the auxiliary switch in the off position.

In the nonenergized condition of the drive of the contactor according to FIG. 2, however, the spring force of the pressure springs 2, 3 in the "switch-off direction" of the contact bridge support 10 is at a maximum. Speaking here of the spring force of the pressure springs 2, 3 means in each case the component of the pressure springs acting in the direction of the axis of movement 1 of the contact bridge support 10. The return pressure force of the pressure springs 2, 3 is lowest in the attracted stage of the contactor.

I claim:

1. Auxiliary switch for an electromagnetic switching device with a drive, said switch comprising, in a multipartite housing equipped with fixed contacts, a contact bridge support secured in its position by means of a pressure spring and movable against the spring force upon energization/nonenergization of the drive of the switching device, said contact bridge support being provided with bridge contacts, characterized in that two pressure springs each with an axis located outside of an axis of movement of the contact bridge support are supported in the manner of a two-armed toggle joint respectively with one end in, respectively, one of blind holes formed on mutually opposite sides of the contact bridge support and with the other end in, respectively, one of recesses provided in housing sections, and exhibit a negative return spring characteristic against the tensile force of the drive.

2. Auxiliary switch according to claim 1, characterized in that the bearing surface of the pressure springs at the contact bridge support is arranged so that the spring axes of the pressure springs in the hold condition (upon excitation of the magnet), extend almost perpendicularly to the axis of movement of the contact bridge support.

3. Auxiliary switch according to claims 1 or 2, characterized in that the recesses formed in the housing sections on the side associated with the contact bridge support exhibit a pass-through opening toward the topside of the housing, through which the pressure springs can be introduced with the housing being assembled.

4. Auxiliary switch according to claim 1, characterized in that the housing sections encompassing the contact bridge support can be connected with each other in a shape-mating fashion by means of detent lugs projecting along the parting joint at the housing walls of a housing section and associated detent grooves at the second housing section.

5. Auxiliary switch according to claim 2, characterized in that the housing sections encompassing the contact bridge support can be connected with each other in a shape-mating fashion by means of detent lugs projecting along the parting joint at the housing walls of a housing section and associated detent grooves at the second housing section.

6. Auxiliary switch according to claim 3, characterized in that the housing sections encompassing the contact bridge support can be connected with each other in a shape-mating fashion by means of detent lugs projecting along the parting joint at the housing walls of a housing section and associated detent grooves at the second housing section.

* * * * *